United States Patent [19]

Beyl

[11] 4,330,138

[45] May 18, 1982

[54] COMBINED SKI BOOT AND SAFETY BINDING ASSEMBLY

[75] Inventor: Jean J. A. Beyl, Nevers, France

[73] Assignee: Look, Nevers, France

[21] Appl. No.: 109,840

[22] Filed: Jan. 7, 1980

[30] Foreign Application Priority Data

Feb. 6, 1979 [FR] France ..... 79 02976

[51] Int. Cl.[3] ..... A63C 9/00

[52] U.S. Cl. ..... 280/630; 280/623

[58] Field of Search ..... 280/623–630, 280/631, 632, 611, 613, 618; 36/117–121

[56] References Cited

U.S. PATENT DOCUMENTS

| | | | |
|---|---|---|---|
| 2,879,071 | 3/1959 | King | 280/626 |
| 3,378,271 | 4/1968 | Unger | 280/626 |
| 3,477,735 | 11/1969 | Salomon | 280/623 |
| 3,797,840 | 3/1974 | Unger | 280/626 |
| 3,933,363 | 1/1976 | Schweizer et al. | 280/632 |
| 3,942,810 | 3/1976 | Salomon | 280/618 |
| 3,945,658 | 3/1976 | Frechin | 280/623 |
| 4,000,567 | 1/1977 | Salomon | 280/613 X |

FOREIGN PATENT DOCUMENTS

| | | | |
|---|---|---|---|
| 842166 | 6/1952 | Fed. Rep. of Germany | 36/117 |
| 2308535 | 9/1974 | Fed. Rep. of Germany | 280/613 |
| 92948 | 12/1968 | France | 280/626 |

*Primary Examiner*—Joseph F. Peters, Jr.
*Assistant Examiner*—Donald W. Underwood
*Attorney, Agent, or Firm*—Bierman & Bierman

[57] ABSTRACT

In this assembly comprising a ski boot and a safety ski binding for the heel end of the ski boot, adapted to cooperate with the heel end by means of a heel clamping member, the rounded rear end of the upper extends beyond the heel end of the sole, and a recess is formed between the upper and the sole, the heel clamping member comprising a lever adapted to be depressed by the rear end of the upper for closing this lever upon the edge of the sole when the ski boot is being fitted into the binding, the free outer operative end of the lever being thus caused to penetrate into the recess, so that the device can safely be used even with ski boots having their heel edges bevelled as a consequence of the wear thereof.

9 Claims, 6 Drawing Figures

COMBINED SKI BOOT AND SAFETY BINDING ASSEMBLY

BACKGROUND OF THE INVENTION

1. Field of the Invention

This invention relates to an improved combined ski boot and safety binding assembly adapted to engage the heel end of the ski boot by means of a pivoted heel clamping member to constitute a heel hold-down device. This invention is also concerned with the ski boot on the one hand and with the safety ski binding on the other hand forming together the above-defined assembly.

2. The Prior Art

Hitherto known heel hold-down devices of safety ski bindings comprise a so-called heel clamping or retaining member adapted to firmly and resiliently retain the heel end of the ski boot and press the same against the ski. In case of excessive vertical upward stress, due for example to a forward fall of the skier, the heel clamping member is moved upwards, generally by pivoting about a transverse horizontal axis, and eventually releases the boot.

After this release, the heel clamping member is normally held in its open position.

To reset the ski binding automatically, the heel clamping member is rigid with a lug or pedal adapted to be depressed by the bottom face of the boot sole when the boot is re-introduced into the ski binding in order to urge the heel clamping member back to its boot holding position.

This pedal is known notably through the first Certificate of Addition No. 81,385 to the French Pat. No. 1,294,261.

However, these known heel hold-down devices are objectionable for the following reasons:

- the bottom face of a ski boot sole undergoes relatively fast wear when walking, so that the toe and heel portions thereof become more or less bevelled. Now, it is the bevelled portion of the heel that engages the boot resetting pedal. If this wear is excessive, in many instances the pedal stroke is too short, and therefore insufficient for restoring the heel clamping member to its operative position. This is of course very detrimental.
- on the other hand, snow may tend to accumulate between the pedal and the ski, thus preventing the heel clamping member from resuming completely its operative position.

It is the primary object of the present invention to avoid these known inconveniences by providing a combined ski boot and safety binding assembly of the automatic resetting type wherein the operation of the heel clamping member cannot be detrimentally affected by worn or bevelled edges at the toe and heel ends of the sole.

According to this invention, the heel end of the boot upper extends beyond the rear end of the sole and the heel clamping member consists of a lever having a contour shaped to permit its proper engagement by the rear end of the upper so as to cause this member to be reclosed upon the rear edge of the sole when the boot is refitted into the binding, a recess being provided between the rear ends of the upper and sole for engagement by said heel clamping lever.

Thus, when the skier engages the ski boot with the binding, it is the rear end of the boot upper, not the heel end of the sole, that depresses the heel clamping member and causes the latter to resume its operative or locking position upon the heel end of the boot sole.

Consequently, in case the heel end of the sole becomes worn and bevelled, the efficiency of the heel clamping member is not impaired.

This heel clamping member may be rigid with the ski binding body and at the same time fulcrumed to the ski binding body about a pivot member fixed in relation to the ski.

Other features and advantages of this invention will appear as the following description proceeds with reference to the accompanying drawing in which two typical forms of embodiment of the combined ski boot and safety binding according to this invention are illustrated diagrammatically by way of example.

DESCRIPTION OF THE PREFERRED EMBODIMENTS

Figure 1:
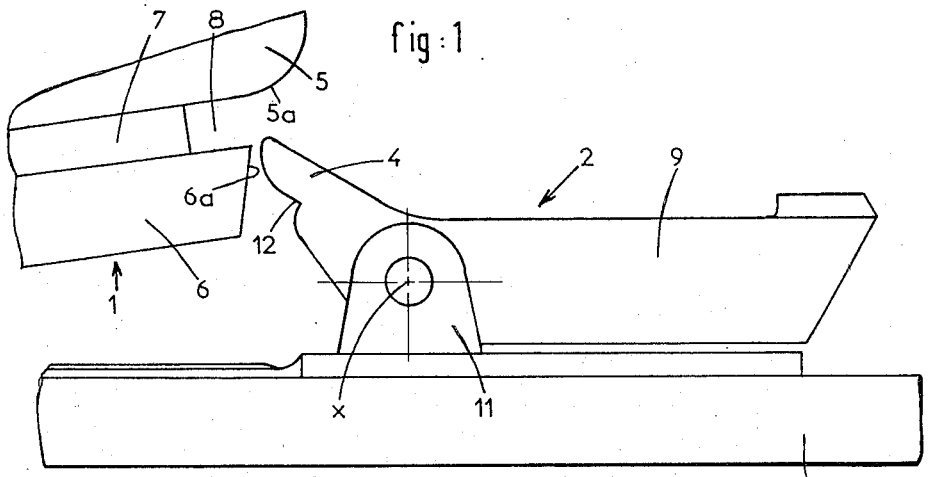
FIG. 1 is a side elevational view showing a first form of embodiment of the combined ski-boot and heel hold-down or clamping device assembly according to this invention, the boot being shown before its actual engagement with the heel hold-down device.
Figure 2:
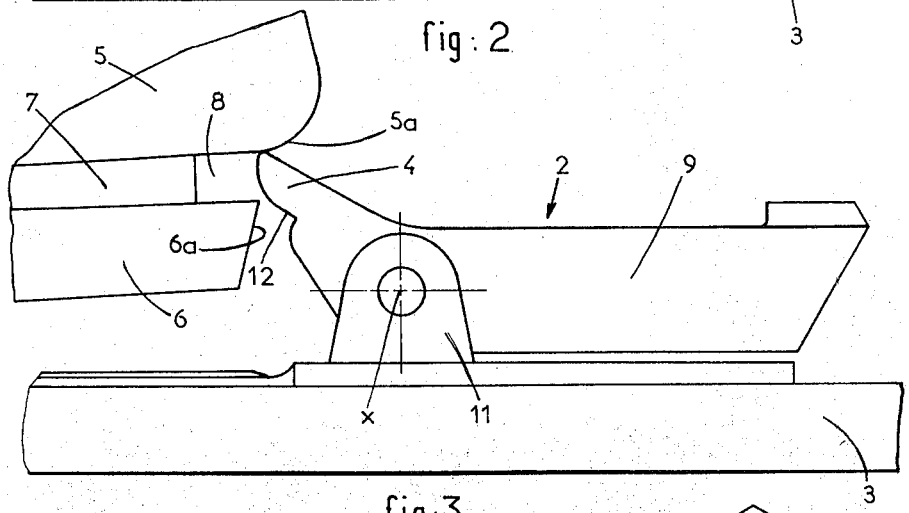
FIG. 2 is a view similar to FIG. 1, showing the boot partially engaged with the binding.
Figure 3:
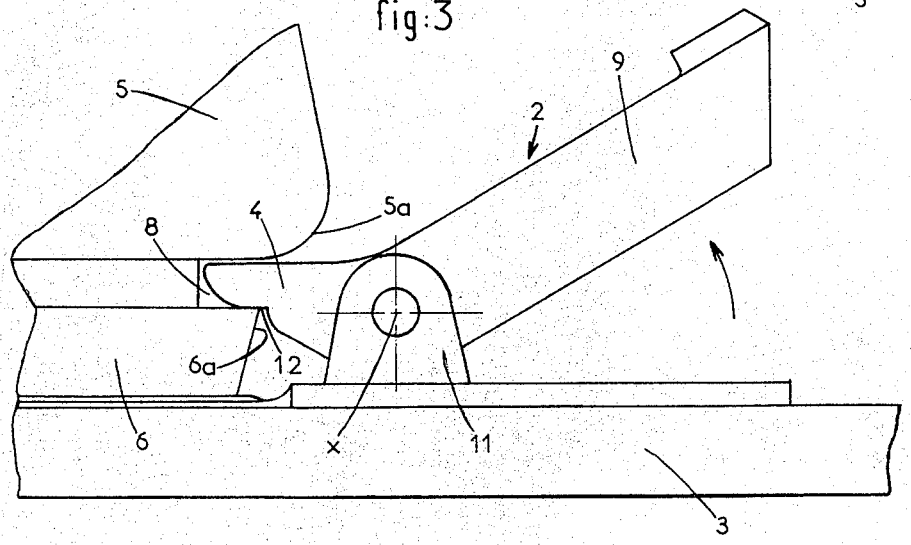
FIG. 3 is a view similar to FIGS. 1 and 2, showing the boot fully engaged with the ski binding.

Referring first to FIGS. 1 to 3, the combined assembly illustrated therein comprises a ski boot 1 and a safety binding 2 mounted on a ski 3 and adapted to cooperate with the heel end of the ski boot 1 to constitute a heel hold-down means provided with a heel clamping member 4.

The boot 1 comprises an upper 5 adapted to receive the skier's heel, and a sole 6 secured to the upper 5 with the interposition of a liner-forming member 7.

According to this invention, the rear end 5*a* of the upper 5 extends beyond the rear end of sole 6; complementarily, the heel clamping or hold-down member 4 consists of a lever shaped for receiving the rounded rear end 5*a* of the upper 5 when fitting the ski boot into the binding, and a recess 8 formed between the rear ends 6*a* and 5*a* of sole 6 and upper 5, respectively, this recess being dimensioned to permit the introduction of the free end of heel clamping member 4 into this recess as the rear end 5*a* of upper 5 is moved backwards to fit the boot into the binding.

The heel clamping member 4 is rigid, and formed integrally, with the ski binding body 9 constituting the heel hold-down device, the complete device being pivotally mounted by means of a pivot member x carried by a strap 11 secured to the ski 3.

Finally, the heel clamping member 4 has formed on its lower edge a notch 12 adapted to fit on the rear edge 6*a* of the boot sole.

The above-described device operates as follows:

When the skier having put on his boots 1 moves the heel portion thereof towards the heel hold-down device 2 for engaging the ski binding, the rounded end or rear portion 5*a* of the upper 5, which protrudes well behind the heel end 6*a* of the sole, bears upon the end portion of pivoting lever 4 then in its raised position, as shown in FIG. 1.

During this movement, the rounded end 5*a* of upper 5 will thus depress the heel clamping member 4 (FIG. 2) and cause same to pivot counterclockwise, as seen in the drawing, and to bear upon the heel end of the sole 6; correlatively, the portion of the heel clamping member 4 extending between its lower notch 12 and its tip will penetrate into the recess 8 formed between the upper 5 and sole 6. This position is illustrated in FIG. 3 showing how the body 9 of the heel hold-down device was tipped upwards while the heel clamping portion 4 pivoted about its axis x for engaging said recess 8.

Thus, as a result of the truncated shape of the sole with respect to the boot upper 5, when the rear end of the sole is worn out or bevelled it cannot interfere with the re-fitting of the boot into the ski binding, since this re-fitting is caused by the rear end of the upper 5 cooperating with the heel hold-down member 4, said upper 5 being of course not liable to wear out when used for walking.

Therefore, the refitting pedal associated with the heel hold-down member in known heel hold-down bindings can be dispensed with, so that a simpler and more economical heel hold-down device can be made. Moreover, eliminating this pedal is also advantageous because if snow accumulates on the ski it cannot prevent the heel clamping member from reclosing completely upon the boot sole 6.

Figure 4:
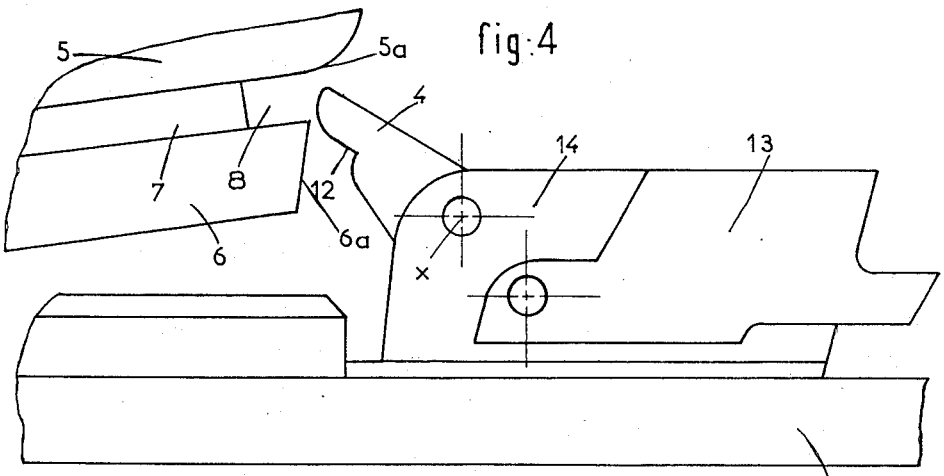
FIGS. 4 to 6 are views similar to FIGS. 1 to 3, respectively, showing a modified form of embodiment of the invention.
Figure 5:
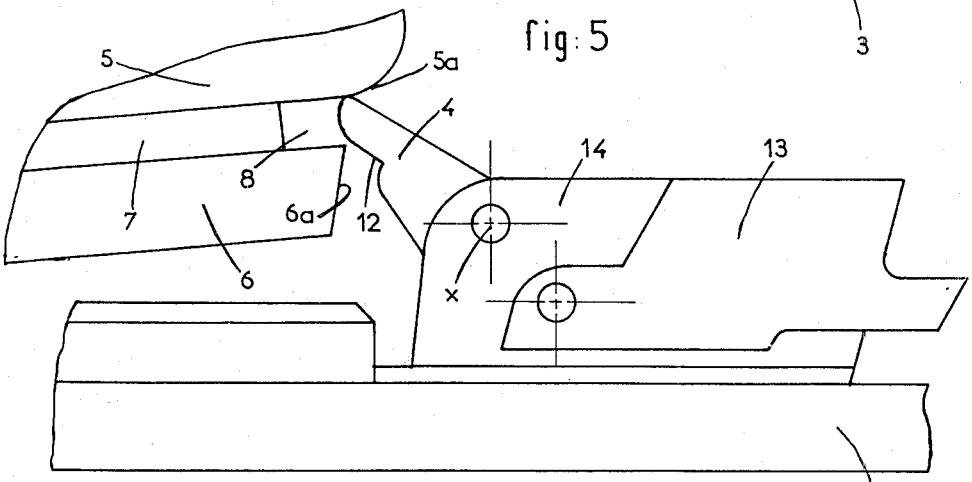
Figure 6:
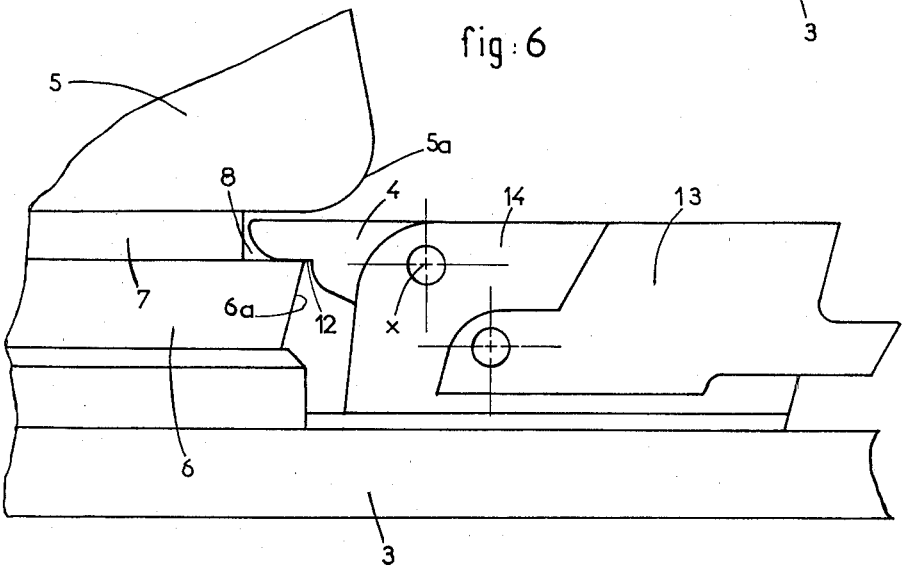

In the modified form of embodiment illustrated in FIGS. 4 to 6 of the drawing the heel clamping member 4 is pivoted to a fixed body 14 to which a lever 13 for controllably releasing the boot is fulcrumed, in contrast to the preceding form of embodiment in which this release is controlled by means of the body 9 of the device.

Otherwise, the mode of operation of the heel hold-down device 4 of FIGS. 4 to 6 is exactly the same as that of the form of embodiment shown in FIGS. 1 to 3.

Of course, this invention should not be construed as being strictly limited by the specific forms of embodiment shown and described herein, since various modifications and changes may be brought thereto, as will readily occur to those conversant with the art. Thus, the heel clamping member may be mounted for vertical translation instead of being pivoted to a support, and the boot 1 may advantageously but not exclusively comprise a standard truncated sole independently of the boot size, according to a known structure.

If a vertically movable heel clamping member is contemplated, it will preferably also be movable obliquely towards the sole so that it can fit between the sole edge and the upper.

What is claimed is:

1. In the combination of a ski boot having a sole and an upper, and a safety ski binding for mounting on an elongated ski blade and adapted to cooperatively retain the heel end of the boot on the ski blade, a heel clamping member of said binding pivotally mounted for movement between an open position and a closed, boot-engaging position in a direction substantially perpendicular to the elongation of a ski blade on which said binding is mounted, said clamping member including a lever having a free end remote from said pivotal mounting and configured for engagement with the heel end of said ski boot, and means on said ski boot for automatic engagement with said safety ski binding as the boot heel end is moved toward the ski blade to fit the boot into the binding, said means comprising a recess formed at the boot heel end between the sole and the upper and dimensioned to permit the introduction of said lever free end into said recess and an extension of the upper rearwardly beyond the heel end of the sole so that as the boot heel end is moved toward the ski to fit the boot into the binding, said lever free end in said open position engages the boot upper which on continued relative movement of the boot automatically pivots the lever to said closed position causing said lever free end to move into said recess for cooperative retention of the boot on the ski blade, and said recess of the ski boot being bounded by substantially parallel, confrontingly spaced apart surfaces of the sole and upper of the boot.

2. In the combination according to claim 1, said safety ski binding further including a pivot member for fixed mounting on the ski blade and with respect to which said heel clamping member is fulcrumed for pivotal movement relative to the ski blade and said pivot member between said open and closed positions, and said clamping member further including a body integral with said lever for pivotal movement therewith with respect to said pivot member.

3. In the combination according to claim 1, said safety ski binding further including a fixed body to which said heel clamping member is fulcrumed for relative movement between said open and closed positions.

4. In the combination according to claim 1, said lever free end having a surface for retaining engagement with the boot sole within said recess in said closed position of the heel engaging member, and a notch defined in said engagement surface and adapted to cooperate with a rear edge of the boot sole in said closed position of the heel engaging member.

5. In the combination according to claim 1, the ski boot upper at the heel end of the boot presenting a smoothly arcuate and continuous surface extending at least from a portion substantially perpendicular to the elongation of a ski blade on which the binding is mounted to said boot recess at which the surface of the upper lies substantially parallel to the ski blade.

6. In a ski boot, means for receiving a pivotally-movable heel clamping member of a safety ski binding and for effecting automatic retaining engagement of the binding with the heel end of the boot, said means comprising a sole having an undersurface for contact with a ski, an upper extending rearwardly beyond the heel end of the sole, and a recess defined between the heel end of the sole and the upper and dimensioned to permit the introduction of the heel clamping member into said recess, said upper including a smoothly arcuate first surface portion for automatically guiding the heel clamping member along said surface portion into said boot recess as the boot is moved into engagement with the binding, and said upper further including a second surface portion in said recess substantially parallel to the undersurface of the boot sole and along which the heel clamping member is guidable after initially entering said recess for automatically completing heel retaining engagement of the binding with the boot heel end.

7. In a ski boot according to claim 6, a liner forming member intermediately disposed connectingly between said upper and said sole.

8. In a ski boot according to claim 6, said sole including a heel clamping member engaging surface in said recess spaced from and substantially parallel to said second surface portion of the upper such that said engaging surface of the sole and said second surface portion of the upper opposingly bound said recess.

9. In the combination of a ski boot and a rear safety ski binding adapted to releasably hold the boot on a ski, the improvement comprising: a ski boot having a sole spaced a substantial distance from an upper at the heel end of the boot, and in which the upper extends substantially rearwardly of the sole, whereby the end of the sole and the end of the upper are formed with a recess between them bounded by substantially parallel, confrontingly spaced apart surfaces of the sole and upper of the boot, and in which the rear ski binding is formed with a lever pivotally mounted on the ski for movement in a vertical direction, said lever being so positioned relative to said boot that when said boot is in a free position above the ski, said lever is positioned beneath the rearwardly extending upper but rearwardly of said recess, and so that as said boot is moved downwardly toward the ski said upper pushes said lever into said recess between the sole and the upper to hold said boot on the ski.

* * * * *